US010249461B2

(12) United States Patent
Bordet et al.

(10) Patent No.: US 10,249,461 B2
(45) Date of Patent: Apr. 2, 2019

(54) CONTROLLABLE TRIPOUT FOR AN ELECTRICAL CIRCUIT BREAKER

(71) Applicant: Schneider Electric Industries SAS, Rueil Malmaison (FR)

(72) Inventors: Bruno Bordet, Saint Martin le Vinoux (FR); Lionel Urankar, Fontaine (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 21 days.

(21) Appl. No.: 15/668,199

(22) Filed: Aug. 3, 2017

(65) Prior Publication Data

US 2018/0061604 A1 Mar. 1, 2018

(30) Foreign Application Priority Data

Aug. 23, 2016 (FR) ..... 16 57867

(51) Int. Cl.
*H01H 50/02* (2006.01)
*H01H 47/04* (2006.01)
(Continued)

(52) U.S. Cl.
CPC ..... *H01H 50/021* (2013.01); *H01H 47/04* (2013.01); *H01H 71/68* (2013.01);
(Continued)

(58) Field of Classification Search
CPC ..... H01H 71/68; H01H 89/08; H01H 51/00; H01H 2047/006; H01H 2071/665;
(Continued)

(56) References Cited

U.S. PATENT DOCUMENTS 5,180,051 A 1/1993 Cook et al.
5,539,608 A * 7/1996 Hurley ..... G01R 31/3278 361/152
(Continued)

FOREIGN PATENT DOCUMENTS

| | | |
|---|---|---|
| DE | 196 35 358 A1 | 2/1998 |
| EP | 1 209 712 A1 | 5/2002 |
| WO | WO 97/00525 A1 | 1/1997 |

OTHER PUBLICATIONS

French Preliminary Search Report dated May 12, 2017 in French Application 16 57867, filed Aug. 23, 2016 (with English Translation of Categories of cited documents).

*Primary Examiner* — Mohamad Musleh
(74) *Attorney, Agent, or Firm* — Oblon, McClelland, Maier & Neustadt, L.L.P.

(57) ABSTRACT

A controllable trip device includes a magnetic actuator, including a coupling member intended to be coupled to a switching mechanism of an electrical circuit breaker to cause the switching thereof and a coil configured to displace the coupling member towards a tripped position when it is supplied with a pulse of a current of intensity greater than a first predefined threshold for a duration greater than or equal to a predefined duration, a control device, configured to supply the coil, immediately on receipt of a control signal, with a series of pulses of duration equal to the predefined duration and of intensity greater than or equal to the first threshold and less than or equal to a second threshold equal at most to 120% of the first threshold.

11 Claims, 4 Drawing Sheets

(51) Int. Cl.

| | |
|---|---|
| ***H01H 71/68*** | (2006.01) |
| ***H01H 89/08*** | (2006.01) |
| *H01H 47/02* | (2006.01) |
| *H01H 51/00* | (2006.01) |
| *H01H 47/00* | (2006.01) |
| *H01H 71/66* | (2006.01) |

(52) U.S. Cl.
CPC ..... *H01H 89/08* (2013.01); *H01H 51/00* (2013.01); *H01H 2047/006* (2013.01); *H01H 2047/025* (2013.01); *H01H 2071/665* (2013.01); *H01H 2300/024* (2013.01)

(58) Field of Classification Search
CPC ..... H01H 2300/024; H01H 47/04; H01H 50/021; H01H 2047/025
See application file for complete search history.

(56) References Cited

U.S. PATENT DOCUMENTS

| | | | | |
|---|---|---|---|---|
| 5,757,598 | A * | 5/1998 | Aromin | H01H 47/04 361/42 |
| 6,052,266 | A * | 4/2000 | Aromin | H01H 47/04 361/42 |
| 6,845,001 | B1 * | 1/2005 | Kinbara | H01F 7/1844 361/152 |
| 2005/0135040 | A1 | 6/2005 | Suzuki et al. | |
| 2015/0171614 | A1 | 6/2015 | Hymel et al. | |

* cited by examiner

CONTROLLABLE TRIPOUT FOR AN ELECTRICAL CIRCUIT BREAKER

The present invention concerns a controllable trip device for an electrical circuit breaker. The invention also concerns electrical switchgear including an electrical circuit breaker and a trip device of this kind associated with that electrical circuit breaker. The invention finally concerns a method of operating a trip device of this kind.

As is known, a trip device for an electrical circuit breaker has the function of opening the circuit breaker with which it is associated so as to interrupt the flow of electrical current between the input and output terminals of the circuit breaker when the trip device receives a dedicated command signal. For example, this command signal is sent when an operator presses an emergency stop button. The objective of the trip device is to open the circuit breaker as rapidly as possible after the reception of this command signal, even if a control circuit incorporated into the circuit breaker has not detected anomalous operation of the circuit breaker. It is therefore crucial that tripping by the trip device be effected as rapidly as possible and reliably.

There are known in particular mechanical trip devices that are intended to be mechanically coupled to a switching mechanism of the circuit breaker. These trip devices typically include a motorised actuator for moving and retaining in place a switching mechanism of the circuit breaker for opening the circuit breaker.

A drawback of these known trip devices is that they dissipate a great amount of heat when they operate because of the requirement to supply electrical energy to the motorised actuator. Another drawback is that it is necessary to supply the motorised actuator with electrical energy continuously in order to retain the switching mechanism in the open state. This leads to high electrical power consumption and therefore also to high heat dissipation. Such heat dissipation is undesirable because it generates heating of the trip device that can degrade its operation. Moreover, such heating is particularly harmful if there is a requirement to miniaturise the trip device or if the trip device is used in a constricted environment.

It is these drawbacks that the invention more particularly intends to eliminate by proposing a controllable trip device for an electrical circuit breaker that dissipates less heat in operation.

The invention therefore consists in a controllable trip device for an electrical circuit breaker, the circuit breaker being switchable between an open state and a closed state, this trip device including:

- an actuator comprising a coupling member movable between a rest position and a tripped position, the coupling member being intended to be mechanically coupled to a switching mechanism of an electrical circuit breaker to cause the switching of the circuit breaker from a closed state to an open state when the coupling member goes from the rest position to the tripped position, and
- a control device configured to energise the actuator in response to the reception by the trip device of a tripping command signal in order to move the coupling member from the rest position to the tripped position.

The actuator is a magnetic actuator including a coil configured to move the coupling member from the rest position to the tripped position when it is energised by an electrical current pulse of intensity greater than a predefined first threshold for a time greater than or equal to a predefined time and the control device is configured to energise the coil electrically immediately on reception of the command signal and for as long as the command signal continues to be received by means of a series of electrical current pulses with a duration equal to the predefined time and of intensity greater than or equal to the first threshold and less than or equal to a second threshold, this second threshold being equal at most to 120% of the first threshold.

Thanks to the invention, using a magnetic actuator of this kind the movement of the coupling member to its tripped position necessitates only a small quantity of energy, which is supplied by an electrical current pulse in the coil. Moreover, the circuit breaker is locked in the open state by activating the coil at successive times by means of the succession of current pulses.

In contrast, in prior art motorised actuators it is necessary to provide a continuous supply of electrical energy to trip the switching of the circuit breaker to the open state and to lock it in the open state, which consumes more energy.

Finally, limiting the intensity of the current pulses to a value less than the second predefined threshold makes it possible not to supply too much energy to the coil and to limit the quantity of energy that is supplied to the coil to the quantity of energy necessary for it to release the coupling member in order for it to go to the tripped position.

Because the consumption of electrical energy is reduced compared to known trip devices, the quantity of heat that is dissipated by the trip device is reduced.

According to advantageous aspects of the invention that are not obligatory, a trip device of the above kind may have one or more of the following features, in any technically permissible combination:

The command signal is an electrical voltage received at an input of the trip device, the control device being adapted to be electrically energised by the command signal, and the control device includes:

- a current-limited voltage-regulated supply connected in series with the coil between the input and an electrical ground of the control device, this current-limited voltage-regulated supply being configured to deliver a supply voltage on a supply rail as soon as it is energised by the command signal,
- an excitation module configured to be electrically energised by the supply voltage and to control the generation of the electrical current pulses, the current-limited voltage-regulated source being moreover configured alternately to inject selectively into the coil an electrical current of intensity equal to the second predetermined threshold and to interrupt the flow of this electrical current in response to tripping and interruption commands generated by the excitation module;

The control device includes a controllable switch connected in series with the coil and the current-limited voltage-regulated supply between the input and the electrical ground, the supply being controlled by the excitation module by means of this switch, the switch being to this end connected to the excitation module and able to switch between a conducting state and a blocking state in order respectively to allow or to inhibit the flow of the electrical current in response to the tripping and interruption commands generated by the excitation module;

The control device includes a probe for measuring the current flowing through the coil and the excitation module is programmed successively to activate and then to inhibit the injection of the electrical current by the current-limited voltage-regulated supply to generate each electrical current pulse, the excitation module being programmed to command this inhibition on the expiry of the predetermined time, this time being counted down by the excitation module from the time at which the current measured by the measurement probe exceeds the first threshold value;

The excitation module is programmed to detect if the command signal is a DC or AC electrical voltage and alternately:

to synchronise automatically the generation of the electrical current pulses with the command signal if the command signal is detected as being an AC electrical voltage, this synchronisation being carried out by the excitation module by generating the tripping commands at the times at which the command signal assumes a null value, and to command the generation of the electrical current pulses with a predefined period if the command signal is detected as being a DC electrical voltage;

The excitation module is programmed to command the generation of the electrical current pulses with a predefined interval between two consecutive electrical current pulses, the predefined interval being less than or equal to 100 ms.

The cyclic ratio between the predetermined time and the predefined interval is between 1/10 and 1/100 inclusive, preferably equal to 1/40;

The control device includes an analog excitation module configured to generate a single electrical current pulse of intensity greater than or equal to the predetermined first threshold immediately on reception of the command signal by the control device;

The actuator further includes a magnet, a mobile part mechanically connected to the coupling member and a tripping spring, the magnet being secured to a fixed part of the actuator and exerting a magnetic force on the mobile part when the coupling member is in the rest position so that the mobile part compresses the spring to retain the coupling member in the rest position, the spring exerting a return force opposing the magnetic force less than the magnetic force, the coil being adapted to reduce the force of magnetic attraction exerted by the magnet when it is energised by each of said electrical current pulses applied by the control device so as to allow the movement of the coupling member from its rest position to the tripped position because of the effect of the return force exerted by the tripping spring;

According to another aspect, the invention concerns electrical switchgear including a circuit breaker and a controllable trip device associated with the circuit breaker, the circuit breaker includes a switching mechanism intended to switch the circuit breaker between an open state and a closed state, the trip device includes:

an actuator comprising a coupling member movable between a rest position and a tripped position, the coupling member being mechanically coupled to a switching mechanism to cause the switching of the circuit breaker from the closed state to the open state when it goes from the rest position to the tripped position, and a control device configured to energise the actuator in response to the reception by the trip device of a tripping command signal in order to move the coupling member from the rest position to the tripped position;

the actuator is a magnetic actuator including a coil configured to move the coupling member from the rest position to the tripped position when it is energised with an electrical current pulse of intensity greater than a predefined first threshold for a time greater than or equal to a predefined time and the control device is configured to energise the coil electrically immediately on reception of the command signal and for as long as the command signal is maintained by means of a series of electrical current pulses having a duration equal to the predefined time and of intensity greater than or equal to the first threshold and less than or equal to a predefined second threshold, this second threshold being equal at most to 120% of the first threshold; According to a further aspect, the invention concerns a method including steps of:

a) procuring a trip device including an actuator comprising a coupling member movable between a rest position and a tripped position, the coupling member being intended to be mechanically coupled to a switching mechanism of an electrical circuit breaker to cause the switching of the circuit breaker from a closed state to an open state when the coupling member goes from the rest position to the tripped position, the actuator being a magnetic actuator including a coil configured to move the coupling member from the rest position to the tripped position when it is energised with an electrical current pulse of intensity greater than a predefined first threshold for a time greater than or equal to a predefined time, and a control device configured to energise the actuator in response to the reception by the trip device of a tripping command signal in order to move the coupling member from the rest position to the tripped position, b) the trip device acquiring a tripping command signal, c) energization of the coil by the control device by means of a series of electrical current pulses having a duration equal to the predefined time and of intensity greater than or equal to the first threshold and less than or equal to a second threshold, this second threshold being at most equal to 120% of the first threshold, this energization being applied immediately on reception of the command signal and for as long as the command signal continues to be received by the trip device;

The invention will be better understood and other advantages thereof will become more clearly apparent in the light of the following description of one embodiment of a controllable trip device given by way of example only and with reference to the appended drawings, in which.

Figure 1:
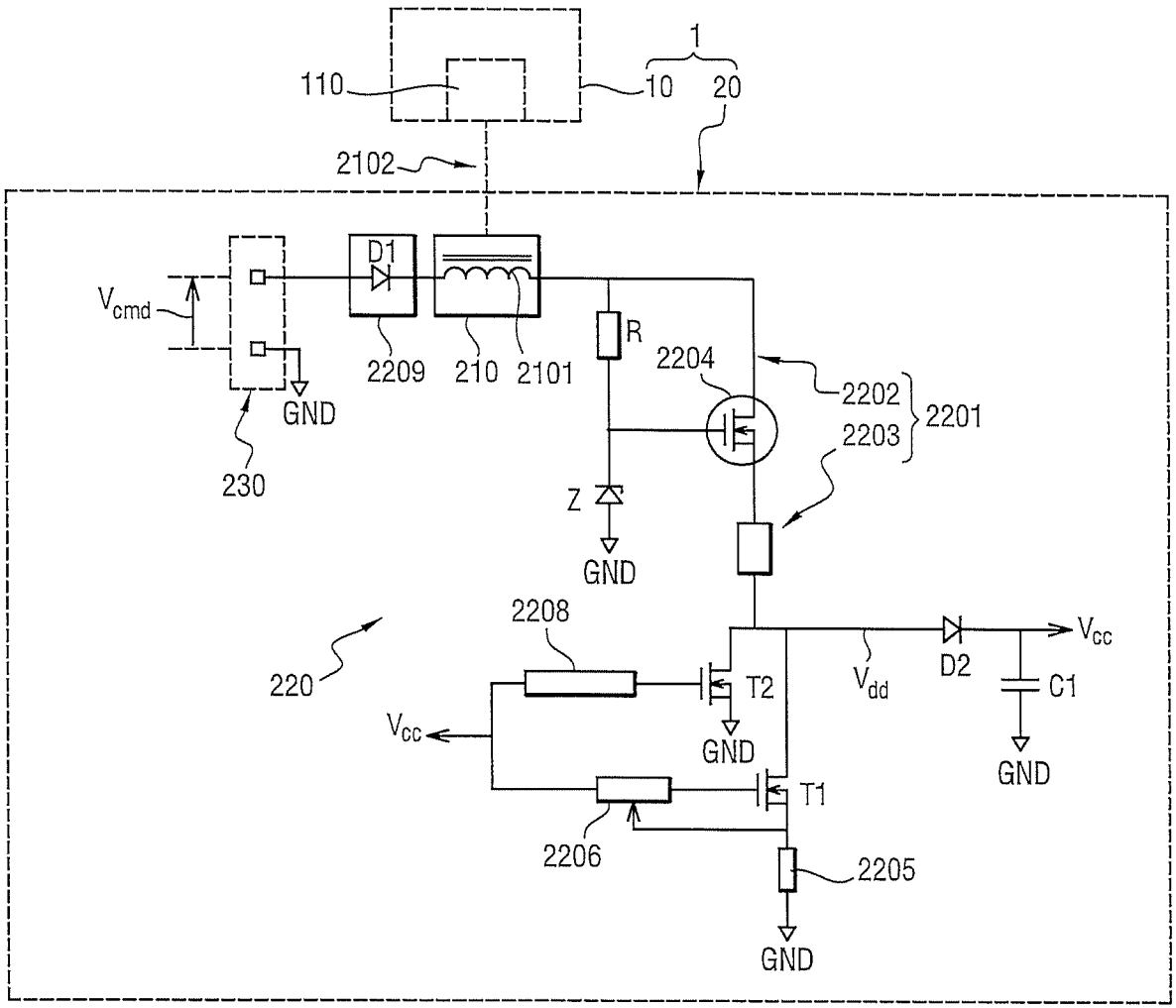
FIG. 1 is a simplified diagram of electrical switchgear including a controllable trip device according to the invention associated with an electrical circuit breaker.

FIG. 1 is an electrical circuit diagram of electrical switchgear 1 comprising an electrical circuit breaker 10 and a controllable trip device 20 coupled to the circuit breaker 10 to control that circuit breaker 10.

The circuit breaker 10 is an electrical circuit breaker, for example a low-voltage high-current circuit breaker. The electrical voltage is of the order of 690 V, for example.

The circuit breaker 10 has input and output terminals that are selectively electrically connected to one another or isolated from one another by separatable electrical contacts. The circuit breaker 10 includes a switching mechanism 110 configured to move these separatable electrical contacts between an open state and a closed state. Here the switching mechanism 110 is of the type known as a tumbler.

In the open state the circuit breaker 10 inhibits the flow of electrical current between the input and output terminals. In the closed state the circuit breaker allows the flow of electrical current between the input and output terminals. The term "opening" denotes the changing of the circuit breaker 10 from the closed state to the open state.

The circuit breaker 10 further includes a control lever, or crank, coupled to the switching mechanism 110 to enable a user to switch the circuit breaker manually between the open and closed states.

The circuit breaker 10 also includes a detection circuit configured to switch the mechanism 110 to the open state on detection of an electrical anomaly, such as an overcurrent or a short circuit.

The trip device 20 is configured to force the switching of the circuit breaker 10 from its closed state to its open state if the trip device receives a tripping command.

The trip device 20 therefore makes it possible to force the switching of the circuit breaker 10 to the open state independently of the detection circuit of the circuit breaker 10. For example, this tripping command signal is generated following the action of a user on an emergency stop switch or pushbutton which controls a power supply unit that generates the command.

In this example the command signal is an electrical voltage Vcmd. For example, the command signal Vcmd is a DC voltage. Alternatively, it can be an AC voltage.

The trip device 20 must retain the circuit breaker 10 in the open state for as long as it receives the command signal Vcmd. In particular, the trip device 20 must preferably implement a function of locking the circuit breaker 10 in the open state after it has tripped opening thereof.

In fact, there is a risk of the mobile contacts of the circuit breaker 10 closing if the control lever of the circuit breaker 10 is manoeuvred from the open position to the closed position. This kind of closure is not allowed and must therefore be prevented, as it would contravene safety requirements.

The trip device 20 thus includes an actuator 210, a device 220 for controlling the actuator and an input 230 for the command signal Vcmd. Here the input 230 includes two terminals one of which is connected to an electrical ground GND of the control device 220.

The actuator 210 is a magnetic actuator including a coil 2101 and a coupling member 2102 adapted to be mechanically coupled to the switching mechanism 110.

The actuator 210 is adapted to be controlled by the control device 220.

The member 2102 is selectively movable between a rest position and a tripped position. The member 2102 is configured so that the movement from its rest position to its tripped position causes switching of the mechanism 110 to open the circuit breaker 10.

In this example, the coupling member 2102 is mechanically coupled to the mechanism 110, for example by the control lever of the circuit breaker 10.

On the other hand, in this example the movement of the member 2102 from the tripped position to the rest position does not automatically cause the switching of the mechanism 110 from the open state to the closed state. Here, for safety reasons, this switching must be effected manually using the control lever of the circuit breaker 10.

The coil 2101 is configured to move the coupling member 2102 from the rest position to the tripped position when it is fed with an electrical current pulse of intensity greater than a predefined first threshold I-min for a time greater than or equal to a predefined time T-on.

Here the coupling member 2102 does not return automatically to its rest position as soon as the coil 2101 ceases to be energised when coupled to the control mechanism 110.

In this example, the actuator 210 includes a magnet secured to the fixed part of the actuator 210 and a spring, termed the tripping spring. The actuator 210 also includes a mobile part mechanically connected to the coupling member 2102, for example. The magnet exerts a magnetic force on the mobile part so that the mobile part holds the spring in a compressed state. The return force exerted by the spring on the mobile part is less than the magnetic force exerted by the magnet. This holds the coupling member 2102 in the rest position. In other words, the return force exerted by the tripping spring is not sufficient on its own to overcome the magnetic force and move the member 2102 toward the tripped position.

The coil 2101 is adapted to demagnetize the magnet at least partly when it is fed with each of said electrical current pulses supplied by the control device 220 so as to reduce the magnetic force to a value less than that of the return force exerted by the spring or even to interrupt the magnetic force and thus allow the movement of the coupling member 2102 from its rest position to the tripped position because of the effect of the return force exerted by the tripping spring. In other words, in this example the coil 2101 is configured to move the coupling member 2102 from the rest position to the tripped position indirectly, notably via the magnet and the tripping spring.

For example, the coil 2101 includes an electrical conductor such as a copper wire wound around this magnet to form turns. Thus when the coil 2101 is fed with the electrical current pulse it creates a magnetic flux within the magnet that opposes the magnet's own magnetic flux, thus interrupting the magnetic force.

Figure 3:
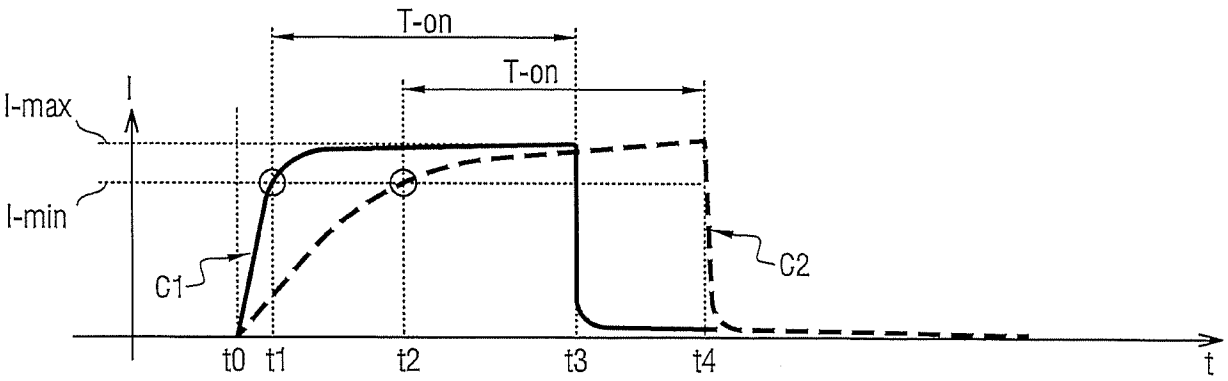
FIG. 3 represents diagrammatically the evolution over time of the electrical current that flows through a coil of an actuator of the electrical switchgear from FIG. 1 in response to the tripping and interruption commands from FIG. 2.

Thus to move or to release the member 2102 to the tripped position, the coil 2101 is fed with an electrical pulse of intensity greater than the current threshold I-min for a time at least equal to T-on (FIG. 3). In contrast to known motorised actuators, it is not necessary to maintain a continuous supply of electrical energy. This reduces the energy consumption and therefore the heat dissipation.

The predefined threshold value I-min and the predefined time T-on are chosen as a function of the actuator 210 and notably as a function of the quantity of energy that it is necessary to feed to the coil 2101 in order to reduce the magnetic force to a level lower than the return force of the tripping spring to cause the member 2102 to move to the tripped position.

Here, in this example, the predefined time T-on is equal to 1 ms. The minimum current I-min is such that the magnetic force generated by the coil 2101 is equal to 150 ampere-.turns.

As is known, in the MKS system of units the magnetic force generated by the coil 2101 is expressed as the product of the current feeding this coil 2101 multiplied by the number of turns of this coil 2101.

For example, the value of the magnetic field generated by the coil 2101 is sufficient to demagnetise the magnet but not too high in order to remain less than the saturation field of the materials forming the mobile and fixed parts of the actuator 210, here equal to 1.5 Tesla.

The control device 220 is configured to energise the actuator 210 in response to the reception of the command signal Vcmd. The device 220 is also configured to lock the circuit breaker in the open state for as long as the command signal Vcmd continues to be applied to the input 230.

To be more precise, the control device 220 is configured to energise the coil 2101 electrically immediately the command signal Vcmd is received and for as long as the command signal Vcmd continues to be received by means of a series of electrical current pulses each of duration equal to the predefined time T-on. The intensity of each of the current pulses of the series is greater than or equal to the first threshold I-min and less than or equal to a second threshold I-max, also termed the "limit current".

The limit current I-max is greater than the threshold I-min and is less than or equal to 120% of the threshold I-min, preferably less than or equal to 110% of the threshold I-min, even more preferably less than or equal to 105% of the threshold I-min.

For example, the limit current I-max is equal to 10 mA.

In this example the coil 2101 includes a number N of turns between 500 and 10,000 inclusive, advantageously chosen as a function of the command voltage Vcmd. The limit current I-max is therefore equal to I-min×1.2/N here, or preferably I-min×1.1/N, or more preferably I-min×1.05/N. Depending on the command voltage Vcmd, the limit current I-max is between 15 mA and 265 mA inclusive, for example.

Thanks to the choice of the value of the limit current I-max, the supply of current to the coil 2101 is optimised as a function of the characteristics of the actuator 210 so that the coil 2101 is fed with a quantity of energy that is just sufficient to move the coupling member 2102 by demagnetising the magnet so as to release to the spring but is not too much greater than what is necessary for this movement. This avoids unnecessary energy consumption and therefore reduces heat dissipation.

In this example, as the command signal Vcmd is an electrical voltage, the control device 220 is adapted to be electrically energized by this command signal Vcmd.

To this end the control device 220 advantageously includes a voltage rectifier 2209 that is connected to the input 230. Here the rectifier 2209 is a half-wave rectifier. In this example it employs a diode D1 connected to the input 230.

Alternatively, the rectifier 2209 is a full-wave rectifier. The actuator 210 can then be used either in a trip device 20 intended to be controlled by a DC voltage command signal Vcmd or by an AC voltage command signal Vcmd.

The control device 220 is therefore able to function reliably without requiring any onboard energy source other than that provided by the command signal Vcmd.

Here the control device 220 includes a current-limited voltage-regulated supply 2201 and an excitation module 2206. In this example the excitation module 2206 includes a programmable microcontroller or a microprocessor.

Here the supply 2201 is connected in series with the coil 2101 between the input 230 and the electrical ground GND.

The supply 2201 is configured to deliver a supply voltage Vcc as soon as it is energised by the command signal Vcmd. Moreover, the supply 2201 is configured to inject into the coil 2101 an electrical current with a maximum amplitude equal to the limit current I-max when it is commanded by the excitation module 2206.

To this end the supply 2201 includes a voltage regulator 2202 and a current limiter 2203.

Here the voltage regulator 2202 is a linear regulator comprising a resistor R, a zener diode Z and a power transistor 2204. The diode Z and the resistor R are connected in series between the output of the rectifier 2209 and the ground GND and a mid-point between the diode Z and the resistor R is connected to a control electrode of the transistor 2204.

Here the transistor 2204 is a MOSFET. Alternatively, it is replaced by a power transistor in the form of an insulated gate bipolar transistor (IGBT), in particular if the amplitude of the command signal Vcmd is higher. The type of transistor 2204 used depends on the expected maximum amplitude of the command signal Vcmd. In practice the command signal Vcmd may have a maximum amplitude between 12 V and 690 V inclusive.

The voltage regulator 2202 is therefore adapted to deliver a supply voltage Vcc on a supply rail Vdd when the command signal Vcmd is applied to the input 230. For example, the voltage Vcc is a DC voltage with an amplitude equal to 3.3 volts.

If no command signal Vcmd is applied to the input 230 the voltage regulator 2202 and therefore the supply 2201 do not supply either a voltage or a current.

The current limiter 2203 is configured to limit the current flowing in it to the limit value I-max described above. When the excitation module 2206 allows the injection of a current into the coil 2101, the limiter 2203 therefore prevents the amplitude of this current exceeding the limit current I-max.

The excitation module 2206 is configured to be electrically energized by the supply voltage Vcc and to control the generation of the electrical current pulses by means of the supply 2201.

To be more precise, the excitation module 2206 is programmed successively to activate and then to inhibit the injection of electrical current by the current-limited voltage-regulated supply 2201 to generate each electrical current pulse, activation and then inhibition being separated by a time greater than or equal to the predefined time T-on.

The current-limited voltage-regulated supply 2201 is configured so that it alternately injects into the coil 2101 an electrical current in response to a tripping command sent by the excitation module 2206 and interrupts the flow of that electrical current in response to an interruption command generated by the excitation module 2206.

In this example the control device 220 includes a controllable switch T1 connected in series with the coil 2101 and the supply 2201 between the input 230 and the electrical ground GND. A control electrode of the transistor T1 is electrically connected to a control output of the excitation module 2206.

Here the switch T1 is a MOSFET.

In this example the switch T1 is by default in a blocking state and therefore prevents the flow of electrical current between the output of the supply 2201 and the electrical ground and therefore prevents energization of the coil 2101.

When the module 2206 sends a tripping command to the transistor T1, the latter goes to a conducting state and therefore allows the flow of electrical current through the coil 2101.

When the module 2206 sends an interruption command to the transistor T1 the latter returns to its blocking state and again prevents the flow of electrical current through the coil 2101.

Thus the module 2206 controls the supply 2201 by means of the switch T1.

The voltage regulator 2202 advantageously also includes a circuit for stabilising the supply voltage Vcc. Here this stabilisation circuit is formed by a diode D2 and a capacitor C connected in parallel with the switch T1 in series between the supply rail Vdd and the ground GND. The aim of this stabilisation circuit is to prevent the supply voltage Vcc from falling when the excitation module 2206 operates and notably when the switch T1 goes to the conducting state.

The control device advantageous includes a probe 2205 for measuring the current flowing through the coil 2101. The excitation module 2206 is therefore programmed to command the inhibition of the supply of current by sending an interruption command on the expiry of the predetermined time T-on, that time being counted down by the excitation module 2206, starting from the time at which the current measured by the measuring probe 2205 exceeds the threshold value I-min.

Here the measuring probe 2205 is a precision resistor connected in series with the coil 2101 and connected to a measurement input of the excitation module 2206.

Figure 2:
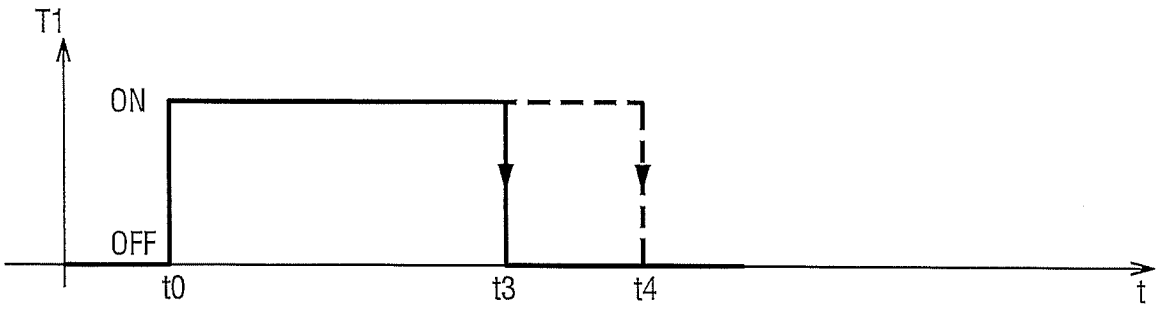
FIG. 2 represents diagrammatically a tripping and interruption command of a switch controllable by an excitation module of a control device of the trip device from FIG. 1.

FIG. 2 shows as a function of time t the evolution of a command signal of the switch T1 sent by the module 2206 between its conducting state, denoted "ON", and its blocking state, denoted "OFF". The time, termed the "tripping time", from which the module 2206 sends a tripping command to cause the switch T1 to go to the conducting state is denoted t0.

As shown in FIG. 3, from this time t0 the current increases until it reaches the limit current I-max set by the limiter 2203.

The rate at which the current increases from the time t0 depends on the position of the coupling member 2102. Depending on whether the member 2102 is in the rest position or the tripped position, the inductance value of the coil 2101 is not the same. Here the inductance of the coil 2101 is higher when the member 2102 is in the rest position. In fact, the response of the coil 2101 to the current passing through it is different.

The curve C1 shows the evolution of the current flowing in the coil 2101 after the time t0 when the member 2102 is in the tripped position.

The time from which this current exceeds the threshold I-min is denoted "t1". After this time t1 the current continues to increase until it reaches the limit current I-max. The excitation module 2206 counts down the elapsed time, for example by means of a timer, starting from the time t1, whilst maintaining the switch T1 in the conducting state.

When the counted down time exceeds the predefined time T-on, the excitation module 2206 sends an interruption command at a time t3. The switch T1 returns to its blocking state and the current threshold ceases to flow in the coil 2101.

The curve C2 shows the evolution of the intensity of the current flowing in the coil after the time t0 when the member 2102 is in the rest position.

Because of the difference in the inductance of the coil 2101, the electrical current increases from the time t0 more slowly than in the curve C1.

The time from which the current exceeds the threshold value I-min is denoted "t2". The difference between the times t2 and t0 is greater than the difference between the times t1 and t0.

Following this time t2, the current continues to increase until it reaches the limit current I-max. As before, the excitation module 2206 maintains the switch T1 in the conducting state and sends an interruption command at a time t4 on expiry of the time T-on. The current then ceases to flow through the coil 2101.

The excitation module 2206 therefore does not allow the flow of an electrical current for longer than necessary to form a pulse of duration T-on, which reduces the electrical power consumption of the trip device 20 and therefore reduces the heat dissipation.

To be more precise, if such regulation were not applied then it would be necessary to predefine the closure time of the transistor T1 as being equal to the difference between the times t4 and t0, on the basis of the worst case scenario, which is that in which the self inductance of the coil is minimal, so as to be certain of always having a pulse of duration at least equal to the time T-on regardless of the state of the coil 2101. In this case the duration of the pulse would have been too long since the current would have continued to be applied between the times t3 and t4 when the coil 2101 had received enough energy to ensure the movement of the member 2102. Excessive heat would therefore have been generated for nothing, because the current supplied between the times t1 and t3 is sufficient to excite the coil and cause switching.

The excitation module 2206 advantageously includes a detection module configured to detect the nature of the command signal Vcmd and notably to determine whether it is a DC or AC electrical voltage. Here this determination is based on the rail voltage Vdd.

The excitation module 2206 is moreover programmed to detect the nature of the command signal using this detection module and to adapt the timing of the sending of the tripping commands, and notably:

to synchronise automatically the generation of the electrical current pulses with the command signal Vcmd when the command signal Vcmd is detected as being a DC or AC electrical voltage, i.e. when the rail voltage Vdd is detected as being a half-wave or full-wave rectified AC voltage, this synchronisation being effected by generating the tripping commands at the times at which the command signal Vcmd assumes a null value, and, alternately, to command the generation of the electrical current pulses with a predefined period if the command signal Vcmd is detected as being a DC electrical voltage.

Synchronisation with the command signal Vcmd makes it possible to generate the electrical current pulses when it has a minimum value and therefore to limit the electrical power consumed by the control device 220.

The excitation module 2206 is preferably programmed so that the time between two consecutive pulses is less than or equal to 100 ms, preferably less than or equal to 50 ms.

This time, or interval, is denoted T-off and is defined as being the time interval between two current pulses greater than or equal to the threshold I-min. In this example the time T-off is equal to 40 ms.

The cyclic ratio between the time T-on and the time T-off, defined as being the ratio T-on/T-off between the times T-on and T-off, is advantageously between 1/10 and 1/100 inclusive, preferably equal to 1/40, which makes it possible to reduce the power consumption.

This time is chosen to limit the risk of failure of the circuit breaker 10 to open. As is known, tumbler type switching mechanisms 110 have an opening limit position P1 and a closure dead position P2. These points P1 and P2 correspond to intermediate positions of the switching mechanism between the open state and the closed state.

The point P1 corresponds to the position of the mechanism 110 from which the opening of the circuit breaker is guaranteed. In other words, when the mechanism 110 passes the point P1 after leaving the closed position the opening of the circuit breaker 10 is guaranteed. The point P1 corresponds to the position releasing a component of the tripping mechanism 110 known as the tripping half-moon.

Alternatively, the point P1 coincides with the open position of the circuit breaker 10.

The point P2 corresponds to the position of the mechanism 110 from which the closing of the circuit breaker can no longer be prevented. In other words, when the mechanism 110 passes the point P2 after leaving the open position the closing of the circuit breaker 10 is certain. This is because of the action of mechanical springs in the switching mechanism 110.

This choice of value for the time T-off therefore makes it possible to guarantee that at least one pulse from the module 2206 is generated when the switching mechanism 110 is between the points P1 and P2 as it moves between the closed and open states. Thanks to this pulse, the coupling member 2102 is again moved toward its tripped position and again forces opening of the circuit breaker before the switching mechanism 110 passes the point P2.

The control device 220 advantageously also includes an analog excitation module 2208 also configured to generate a single electrical current pulse of intensity greater than or equal to the predetermined first threshold I-min immediately on reception of the command signal Vcmd by the control device 220.

This analog excitation module 2208 is separate from the excitation module 2206. Likewise, the single current pulse generated by means of this module 2208 is separate from the series of pulses generated by means of the excitation module 2206.

Figure 4:
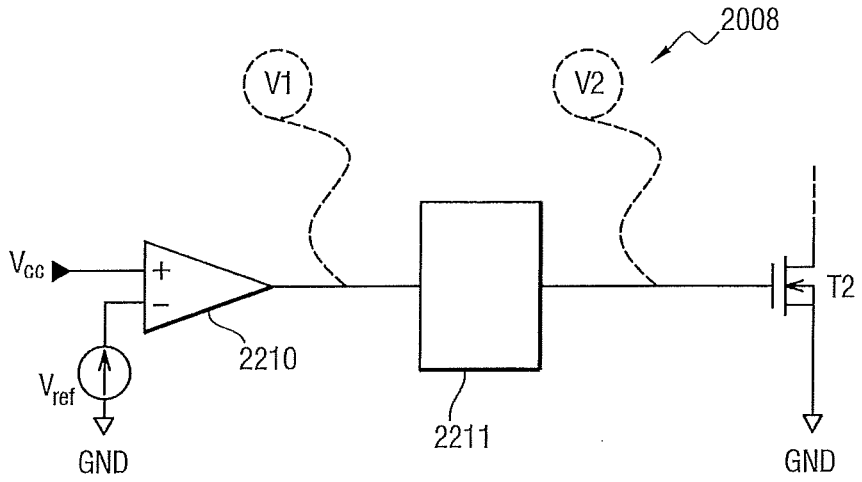
FIG. 4 represents diagrammatically an analog tripping module of the control device of the trip device from FIG. 1.

As shown in FIG. 4, the module 2208 includes a comparator 2210 and a monostable tumbler 2211. For its part the control device 220 includes a controllable switch T2, which is identical to the switch T1, for example.

Here the switch T2 is connected in parallel with the switch T1 between the supply 2201 and the ground GND. In relation to the supply 2201, the role of the switch T2 is analogous to that described for the switch T1 in relation to the module 2206.

The comparator 2210 is configured to compare the supply voltage Vcc with a predefined reference value Vref.

Figure 5:
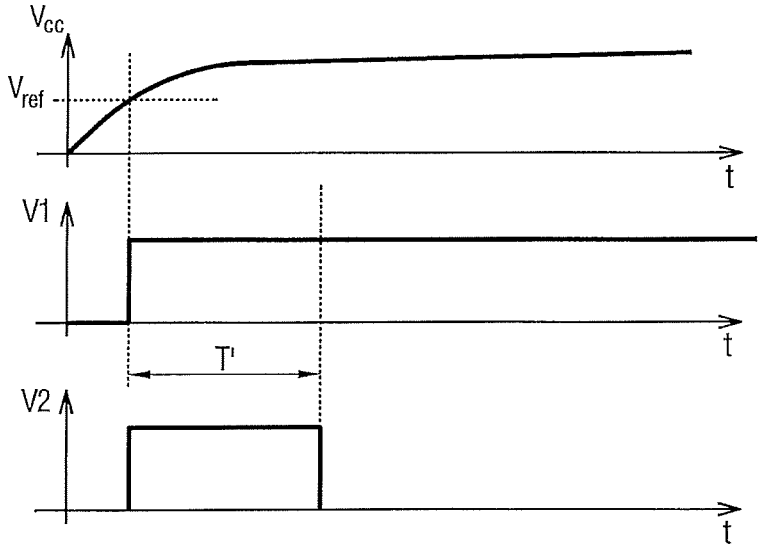
FIG. 5 represents the evolution over time of electrical voltages in the module from FIG. 4 when it operates.

As shown in FIG. 5, when the supply voltage Vcc is applied and exceeds the reference value Vref the comparator 2210 delivers to an input of the monostable tumbler 2211 a voltage here denoted V1.

The value Vref is equal to 3 volts, for example.

The monostable tumbler 2211 is configured to deliver at its output a single voltage pulse having a predefined duration T'. This output is connected to a control electrode of the transistor T2 and this pulse serves as a command for switching the switch T2.

The monostable tumbler 2211 is chosen to have a time T' long enough to guarantee that the electrical current pulse generated has a duration greater than the time T-on. By way of illustrative example, the time T' is equal to 18 ms here.

Alternatively, the switch T2 can be omitted. In this case the module 2208 is adapted to control the switch T1 in parallel with the module 2206, for example by means of an "AND" logic gate that collects the commands sent by the modules 2206 and 2208 and controls the switch T1 accordingly.

The module 2208 is used in addition to the module 2206 and makes it possible to ensure that at least one electrical current pulse is injected into the coil 2201 as soon as the command signal Vcmd is received at the input 230, even in the event of failure of the module 2206. This single pulse has a duration and an intensity sufficient to ensure that the member 2102 is moved to its tripped position.

In fact, because the module 2208 is based on simple analog components rather than programmable microcontrollers or microprocessors, its operation is more reliable and more robust than that of the module 2206. This guarantees failsafe operation of the trip device 20.

Although the module 2208 cannot optimise the duration of the single pulse as finely as the module 2206 can, this is not a problem because only one current pulse is generated by means of the module 2208 each time that the command signal Vcmd is initiated. The additional energy cost is therefore minimal.

In the example shown, the average consumption of the trip device 20 under steady state conditions is less than or equal to 1 W and under transient conditions, on power-up, i.e. on reception of the command signal Vcmd, its consumption is less than or equal to 10 W. In comparison, in known motorised actuator trip devices the average consumption under steady state conditions is greater than 5 W and the consumption under transient conditions is greater than 30 W. Thus the invention considerably reduces the heat dissipation.

Figure 6:
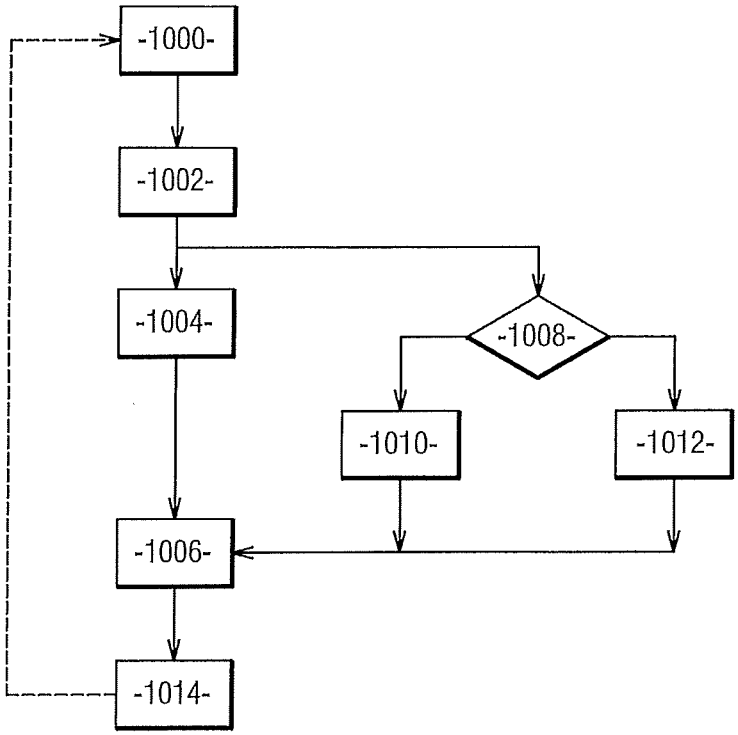
FIG. 6 is a flowchart of a method of operating the trip device from FIG. 1.

An example of the operation of the electrical switchgear 1 and the trip device 20 is described next with reference to the FIG. 6 flowchart and with the aid of FIGS. 1 to 5.

Initially, during a step 1000, the circuit breaker 10 is in a closed state allowing a power electrical current to flow between its input and output terminals. No command signal Vcmd is received at the input 230. The coupling member 2102 is retained in the rest position. No electrical current is injected into the coil 2101.

Then, during a step 1002, the command signal Vcmd is applied to the input 230 of the trip device 20, for example in response to a user pressing an emergency stop button in order to open the circuit breaker 10.

This voltage Vcmd energises the rectifier 2209 and therefore the supply 2201. As both the transistors T1 and T2 are in the open state, no current flows through the coil 2101 at this time. The supply 2201 therefore does not produce any electrical current at this time. However, the voltage regulator 2202 generates the voltage Vcc on the supply rail which in turn energises the excitation modules 2206 and 2208.

During a step 1004 the excitation module 2208 commands the generation by the supply 2201 of a single current pulse intended for the coil 2101.

For example, as soon as the excitation module 2208 is energised because the supply voltage Vcc is greater than the reference value Vref the comparator 2210 delivers the voltage V1 to the input of the monostable tumbler 2211.

In response to this, the monostable tumbler 2211 goes to an excited state for the time T', during which it delivers at its output a non-null voltage V2, then returning to a rest state at the end of this time T'. By doing this, the monostable tumbler 2211 sends a switching command to open and then to close the switch T2, separated by this time T'.

Consequently, during a step 1006, the coil 2101 demagnetises the magnet and allows the spring to go to its relaxed position, which allows the movement of the coupling member 2102 from its rest state to the tripped state. The coupling member 2102 acts on the switching mechanism 110 to open the circuit breaker 10.

In parallel with the step 1004 the excitation module 2206 is energised by the supply voltage Vcc in order to generate the series of current pulses.

During a step 1008, the excitation module 2206 therefore detects automatically if the command signal Vcmd is a DC voltage or an AC voltage.

If the command signal Vcmd is detected as being a DC voltage then, in a step 1010, the current pulses are generated periodically, here with a period equal to the time T-off. For each pulse, starting from the time t0 of tripping of the switch T1, the excitation module 2206 advantageously detects by means of the current probe 2205 the time from which the current that is flowing in the coil 2101 becomes greater than or equal to the threshold value I-min and then after that time sends an interruption command for the switch T1 at the expiry of the time T-on.

On the other hand, if the command signal Vcmd is detected as being an AC voltage then during a step 1012 the current pulses are generated in a manner synchronised with the times for which the command signal Vcmd is detected as assuming a null value. To be more precise, this refers to the tripping times t0 for which the excitation module 2206 sends a command to trip the switch T1 that are synchronised with the times for which the command signal Vcmd is detected as assuming a null value. The generation of each of the pulses starting from this tripping time t0 is here the same as described for the step 1010.

The pulses generated by means of the excitation module 2206 enable the circuit breaker 10 to be switched to and/or maintained in the open state. In the step 1006, for as long as the command signal Vcmd is applied to the input 230, the excitation module 2206 continues to generate the pulses so that the coil 2101 continues to demagnetise the magnet so as to allow the spring to remain in its relaxed position and therefore to hold the coupling member 2102 in its tripped state.

Finally, during a step 1014, the command signal Vcmd ceases to be applied and is no longer received at the input 230. The supply 2201 is interrupted and the supply voltage Vcc falls to zero. The excitation module 2206 then ceases to operate and no further electrical current pulses are sent to the coil 2101.

An operator can then reset the circuit breaker 10 manually to the closed state by means of the control lever. The process described above can then be repeated.

The embodiments and variants envisaged above can be combined with one another to generate new embodiments.

The invention claimed is:

1. A controllable trip device for an electrical circuit breaker, the circuit breaker being switchable between an open state and a closed state, said trip device comprising:

an actuator comprising a coupling member movable between a rest position and a tripped position, the coupling member being intended to be mechanically coupled to a switching mechanism of an electrical circuit breaker to cause the switching of the circuit breaker from a closed state to an open state when the coupling member goes from the rest position to the tripped position, and a control device configured to energise the actuator in response to the reception by the trip device of a tripping command signal in order to move the coupling member from the rest position to the tripped position;

wherein the actuator is a magnetic actuator including a coil configured to move the coupling member from the rest position to the tripped position when it is energised by an electrical current pulse of intensity greater than a predefined first threshold (I-min) for a time greater than or equal to a predefined time (T-on) and wherein the control device is configured to energise the coil electrically immediately on reception of the command signal (Vcmd) and for as long as the command signal (Vcmd) is maintained with a series of electrical current pulses having a duration equal to the predefined time (T-on) and of intensity greater than or equal to the first threshold (I-min) and less than or equal to a second threshold (I-max), said second threshold (I-max) being equal at most to 120% of the first threshold (I-min).

2. The trip device according to claim 1, wherein the command signal (Vcmd) is an electrical voltage received at an input of the trip device, the control device being adapted to be electrically energised by the command signal (Vcmd) and wherein the control device comprises:

a current limited voltage regulated supply connected in series with the coil between the input and an electrical ground (GND) of the control device, said current limited voltage regulated supply being configured to deliver a supply voltage (Vcc) on a supply rail as soon as it is energised by the command signal (Vcmd), an excitation module configured to be electrically energised by the supply voltage (Vcc) and to control the generation of the electrical current pulses, the current limited voltage regulated source being moreover configured so as alternately to inject selectively into the coil an electrical current of intensity equal to the second predetermined threshold (I-max) and to interrupt the flow of this electrical current in response to tripping and interruption commands generated by the excitation module.

3. The trip device according to claim 2, wherein the control device includes a controllable switch (T1) connected in series with the coil and the current-limited voltage regulated supply between the input and the electrical ground (GND), the supply being controlled by the excitation module with said switch (T1), the switch (T1) being to this end connected to the excitation module and able to switch between a conducting state and a blocking state in order respectively to allow or to inhibit the flow of the electrical current in response to the tripping and interruption commands generated by the excitation module.

4. The trip device according to claim 2, wherein the control device includes a probe for measuring the current flowing through the coil and wherein the excitation module is programmed successively to activate and then to inhibit the injection of the electrical current by the current limited voltage regulated supply to generate each electrical current pulse, the excitation module being programmed to command this inhibition on the expiry of the predetermined delay (T-on), said delay being counted down by the excitation module from the time at which the current measured by the measurement probe exceeds the first threshold value (I-min).

5. The trip device according to claim 2, wherein the excitation module is programmed to detect if the command signal (Vcmd) is a DC or AC electrical voltage and alternately:

to synchronise automatically the generation of the electrical current pulses with the command signal (Vcmd) if the command signal (Vcmd) is detected as being an AC electrical voltage, this synchronisation being carried out by the excitation module by generating the tripping commands at the times at which the command signal (Vcmd) assumes a null value, and to command the generation of the electrical current pulses with a predefined period if the command signal (Vcmd) is detected as being a DC electrical voltage.

6. The trip device according to claim 2, wherein the excitation module is programmed to command the generation of the electrical current pulses with a predefined interval (T off) between two consecutive electrical current pulses, the predefined interval (T off) being less than or equal to 100 ms.

7. The trip device according to claim 2, wherein the cyclic ratio between the predetermined time (T-on) and the predefined interval (T-off) is between 1/10 and 1/100 inclusive, preferably equal to 1/40.

8. The trip device according to claim 1, wherein the control device includes an analog excitation module configured to generate a single electrical current pulse of intensity greater than or equal to the predetermined first threshold (I-min) immediately on reception of the command signal (Vcmd) by the control device.

9. The trip device according to claim 1, wherein the actuator further includes a magnet, a mobile part mechanically connected to the coupling member and a tripping spring, the magnet being secured to a fixed part of the actuator and exerting a magnetic force on the mobile part when the coupling member is in the rest position so that the mobile part compresses the spring to retain the coupling member in the rest position, the spring exerting a return force opposing the magnetic force and less than the magnetic force, the coil being adapted to reduce the force of magnetic attraction exerted by the magnet when it is energised by each of said electrical current pulses applied by the control device so as to allow the movement of the coupling member from its rest position to the tripped position because of the effect of the return force exerted by the tripping spring.

10. An electrical switchgear including a circuit breaker and a controllable trip device associated with the circuit breaker, the circuit breaker including a switching mechanism intended to switch the circuit breaker between an open state and a closed state, the trip device including:

an actuator comprising a coupling member movable between a rest position and a tripped position, the coupling member being mechanically coupled to the switching mechanism to cause the switching of the circuit breaker from the closed state to the open state when it goes from the rest position to the tripped position, and a control device configured to energise the actuator in response to the reception by the trip device of a tripping command signal (Vcmd) to move the coupling member from the rest position to the tripped position;

wherein the actuator is a magnetic actuator including a coil configured to move the coupling member from the rest position to the tripped position when it is energised with an electrical current pulse of intensity greater than a predefined first threshold (I-min) for a time greater than or equal to a predefined time (T-on) and wherein the control device is configured to energise the coil electrically immediately on reception of the command signal (Vcmd) and for as long as the command signal (Vcmd) continues to be received by means of a series of electrical current pulses having a duration equal to the predefined time (T-on) and of intensity greater than or equal to the first threshold (I-min) and less than or equal to a second threshold (I-max), this second threshold (I-max) being equal at most to 120% of the first threshold (I-min).

11. A method of controlling a trip device for an electrical circuit breaker, said method comprising the steps of:

a) procuring a trip device including:

an actuator comprising a coupling member movable between a rest position and a tripped position, the coupling member being intended to be mechanically coupled to a switching mechanism of an electrical circuit breaker to cause the switching of the circuit breaker from a closed state to an open state when the coupling member goes from the rest position to the tripped position, the actuator being a magnetic actuator comprising a coil configured to move the coupling member from the rest position to the tripped position when it is energised with an electrical current pulse of intensity greater than a predefined first threshold (I-min) for a time greater than or equal to a predefined time (T-on) and a control device configured to energise the actuator in response to the reception by the trip device of a tripping command signal (Vcmd) in order to move the coupling member from the rest position to the tripped position, b) the trip device acquiring a tripping command signal (Vcmd), c) energization of the coil by the control device with a series of electrical current pulses having a duration equal to the predefined time (T-on) and of intensity greater than or equal to the first threshold (I-min) and less than or equal to a second threshold (I-max), this second threshold (I-max) being at most equal to 120% of the first threshold (I-min), this energization being applied immediately on reception of the command signal (Vcmd) and for as long as the command signal (Vcmd) continues to be received by the trip device.

* * * * *